US007913726B1

(12) United States Patent
Honnell

(10) Patent No.: US 7,913,726 B1
(45) Date of Patent: Mar. 29, 2011

(54) TRAILER-MOUNTED TABLE WOOD SPLITTER

(76) Inventor: James W. Honnell, Prescott, AR (US)

( * ) Notice: Subject to any disclaimer, the term of this patent is extended or adjusted under 35 U.S.C. 154(b) by 0 days.

(21) Appl. No.: 12/909,876

(22) Filed: Oct. 22, 2010

(51) Int. Cl.
*B27L 7/00* (2006.01)
*B27L 7/06* (2006.01)

(52) U.S. Cl. ... 144/4.6; 144/193.2; 144/194; 144/195.1; 144/193.1

(58) Field of Classification Search ..... 144/193.1, 144/193.2, 194, 195.1, 195.7–195.9, 4.6
See application file for complete search history.

(56) References Cited

U.S. PATENT DOCUMENTS 3,938,567 A 2/1976 Dircksen et al.
4,141,396 A 2/1979 McCallister
D253,654 S 12/1979 Davis
D261,143 S 10/1981 Green
4,366,848 A 1/1983 Gavinski
4,470,441 A 9/1984 Wirsbinski et al.
4,487,239 A * 12/1984 Anderson ..... 144/195.1
4,520,854 A 6/1985 May
4,559,985 A * 12/1985 May ..... 144/195.1
4,782,870 A 11/1988 Duerr
5,284,193 A 2/1994 Mires et al.
5,967,206 A * 10/1999 Milton ..... 144/195.1
7,011,123 B2 * 3/2006 Peterson ..... 144/195.1

* cited by examiner

*Primary Examiner* — Shelley Self
(74) *Attorney, Agent, or Firm* — Montgomery Patent and Design; Robert C. Montgomery; Joseph T. Yaksich

(57) ABSTRACT

A trailer-mounted wood splitter with an integral platform, log boom and grappler provides an extended table area to facilitate the splitting of wood. The apparatus comprises a hydraulic-powered wood splitting assembly operated by an internal combustion engine mounted to a trailer. A horizontal surface worktable is provided all around the upper surface of the wood splitting plane. In such a manner, any wood that is placed upon the platform for splitting does not fall off after splitting is complete. This allows the user to reposition any remaining sections of wood for additional splitting without having to pick them up off the ground. Once completely split, the wood can be directed to the side of the table or platform for stacking or transportation. The apparatus further comprises a log boom with a grappler attached to a far end for moving and manipulating felled logs.

20 Claims, 10 Drawing Sheets

TRAILER-MOUNTED TABLE WOOD SPLITTER

RELATED APPLICATIONS

The present invention was first described in a notarized Official Record of Invention on Apr. 22, 2009, that is on file at the offices of Montgomery Patent and Design, LLC, the entire disclosures of which are incorporated herein by reference.

FIELD OF THE INVENTION

The present invention relates generally to log splitters, and in particular, to a trailer-mounted wood splitter having a rotatable boom and log gripping hoist.

BACKGROUND OF THE INVENTION

Firewood from cut trees is used in fires all over the world on a daily basis. Whether the fire is for heating, lighting, general ambience or the like in a home or at a campsite, the wood must be cut and split for the fire. A common method of splitting the wood in the past has been with the use of a hydraulic powered wood splitter. While such a machine makes for quick work of splitting wood, it does allow the split would fall on either side of the machine. This then requires the user to repeatedly lift the larger pieces of wood back up onto the machine for additional splitting. Thus, a single large section of wood such as a tree trunk may require a user to pick up the same section of wood multiple times. Even when finished, smaller sections of wood remain on the ground where they to must be picked back up again for additional transportation or stacking. Typically using a hydraulic wood splitter requires multiple persons to lift and position the larger sections of logs in order for them to be split.

Various hydraulic wood splitters are known and vary in size and manner of use. While these devices may accomplish their specific intended purpose, each suffers from one (1) or more disadvantage or deficiency with respect to design, function, or effectiveness.

SUMMARY OF THE INVENTION

In view of the aforementioned inherent problems and lack in the art, there remains a need for an apparatus by which the process of picking wood up over and over again during splitting processes can be reduced in an effort to save time and energy. It is an object of the present disclosure to solve these problems.

The inventor recognized these problems and has addressed this need by providing an apparatus which provides the features and benefits of a portable table wood splitter with a portable log hoist which departs from the conventional solutions. The inventor recognized the advantages of providing a portable trailer assembly having a floor platform for supporting various operational components. The trailer assembly also provides a wheeled frame and a tow assembly for connection to a towing vehicle for transportation to and from a work site. The inventor also recognized the benefit of providing a hydraulic wood splitting assembly which is mounted to the trailer assembly for driving logs or other wood pieces of various sizes into a splitter wedge affixed to the floor. The inventor also recognized the benefit of providing an integral boom assembly rotatably mounted to the trailer assembly having a mechanically operated hoist and log tong driven by a winch assembly for gripping and moving wood pieces, particularly for placing the wood on the floor to be split by the hydraulic wood splitting assembly. The inventor also recognized the benefit of providing a single drive assembly for mechanically operating both the hydraulic assembly and the winch assembly.

Furthermore, the described features and advantages of the apparatus may be combined in various manners and embodiments as one skilled in the relevant art will recognize. The apparatus can be practiced without one (1) or more of the features and advantages described in a particular embodiment.

Further advantages of the apparatus will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
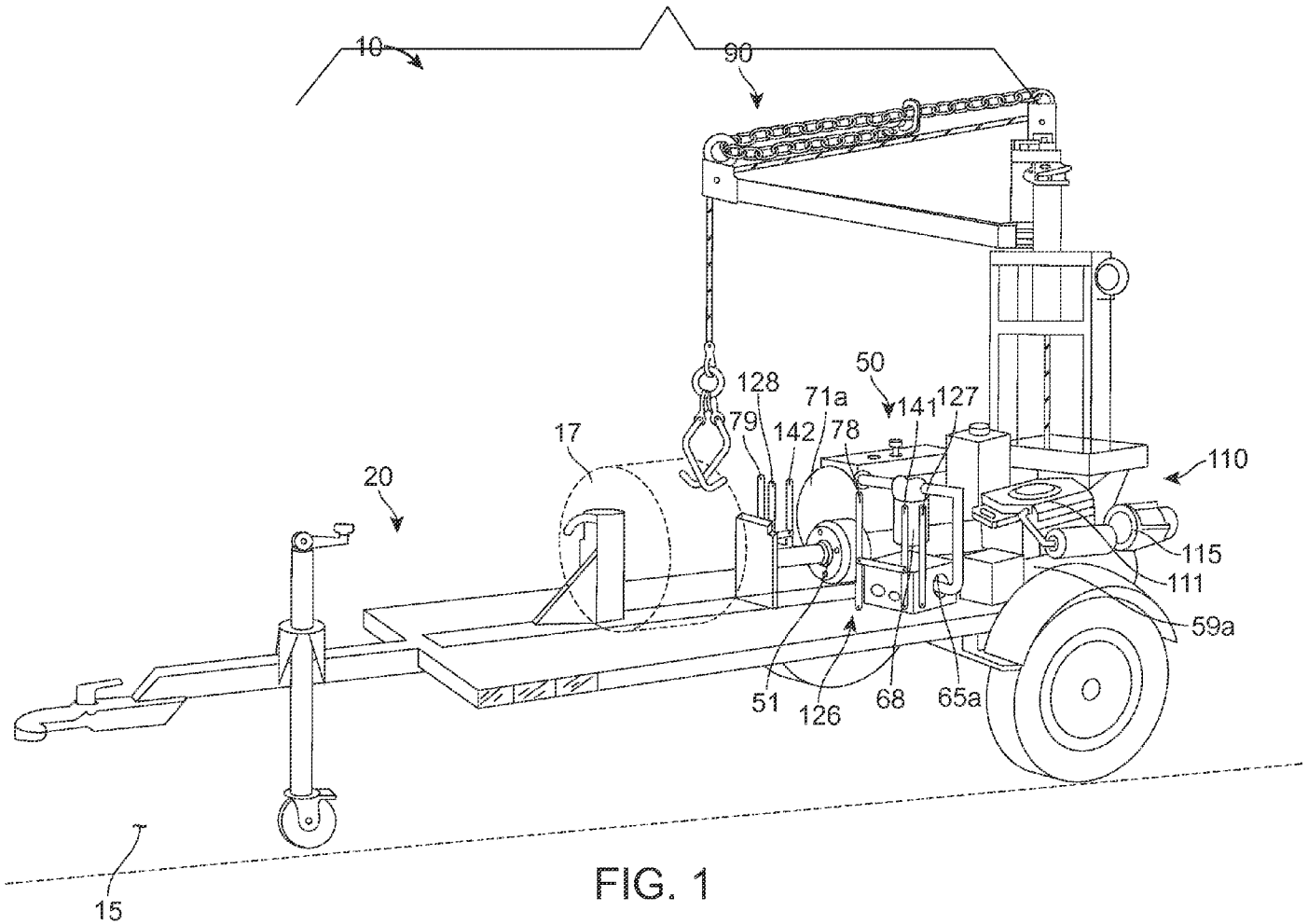
FIG. 1 is a front perspective view of a trailer-mounted table with wood splitter 10, according to a preferred.

10 trailer-mounted table wood splitter
15 surface
17 wood
20 trailer assembly
21 floor
22 hitch
23 tow bar
24 trailer jack
25 handle
26 swivel wheel
27 reflector
28 first wheel
29 second wheel
30*a* first brake light
30*b* second brake light
31*a* splitter wedge
31*b* wedge brace
32 tong hook
33 battery
34 gasoline container

35 gasoline platform
37 supporting structure
38 winch support
39 cable guide
40*a* plate support
40*b* notch
40*c* cable guide aperture
41 front light
42 rear light
50 hydraulic assembly
51 hydraulic cylinder
52*a* cylinder plate
52*b* piston
53 forward port
54 forward hydraulic line
55 rearward port
56 rearward hydraulic line
57 clevis
58 cylinder mount
59*a* hydraulic pump
59*b* pump mount
60 pump shaft
61 pump inlet
62 pump outlet
63 pump line
64 gauge
65*a* control valve
65*b* control valve mount
66 control valve inlet
67 control valve outlet
68 filter
69 filter inlet line
70 filter outlet line
71*a* tank
71*b* tank mount
72 tank inlet
73 tank outlet
74 tank line
75 tank valve
76 tank port
77 hydraulic fluid
78 first hydraulic lever
79 second hydraulic lever
80 control port
90 boom assembly
91 log tong
92 cable
93 chain
94 chain lock link
95*a* front pulley assembly
95*b* rear pulley assembly
96*a* cable enclosure
96*b* roller
97 bushing
98 pin
99 chain loop
101*a* boom
101*b* pivot pin
102*a* pipe
102*b* pipe aperture
103 boom attachment
104 cable aperture
105 horizontal roller
106 roller brackets
107 vertical roller
108 slope plate
109*a* slope plate aperture
109*b* extension
110 drive assembly
111 engine
112 drive shaft
113 engine pulley
114 engine pulley belt
115 transmission
116 transmission shaft
117 transmission input pulley
118 transmission output pulley
119 transmission belt
120 drive pulley
121 friction pulley
122 winch belt
123 winch pulley
124 winch shaft
125 winch spool
126 winch assembly
127 first engaging lever
128 second engaging lever
129 engaging lever link
130 engaging tie rod attachment
131 engaging tie rod
132 first engaging link
133 second engaging link
134 third engaging link
135 spring attachment
136 spring
137 engaging roller
138 roller arm
139 roller sleeve
140 roller sleeve attachment
141 first brake lever
142 second brake lever
143 brake lever link
144 brake tie rod attachment
145 brake tie rod
146 first brake link
147 second brake link
148 third brake link
149 fourth brake link
150 shaft bushing
151 pivot bracket
152 attachment sleeve
153 brake pad
154 braking groove
155 electrical wiring

DETAILED DESCRIPTION OF THE PREFERRED EMBODIMENT

The best mode for carrying out the present disclosure is presented in terms of its preferred embodiment, herein depicted within FIGS. 1 through 10. However, the disclosure is not limited to the described embodiment, and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only one particular configuration shall be shown and described for purposes of clarity and disclosure and not by way of limitation of scope.

The terms "a" and "an" herein do not denote a limitation of quantity, but rather denote the presence of at least one of the referenced items.

The present disclosure depicts and describes a trailer-mounted table wood splitter (herein referred to as the "apparatus") 10, which generally includes a hydraulic powered wood splitter mounted atop a platform for splitting logs, a boom and hoist for lifting the logs onto the splitter platform, an internal combustion drive, and a trailer for mounting and transporting the functional components.

Figure 2:
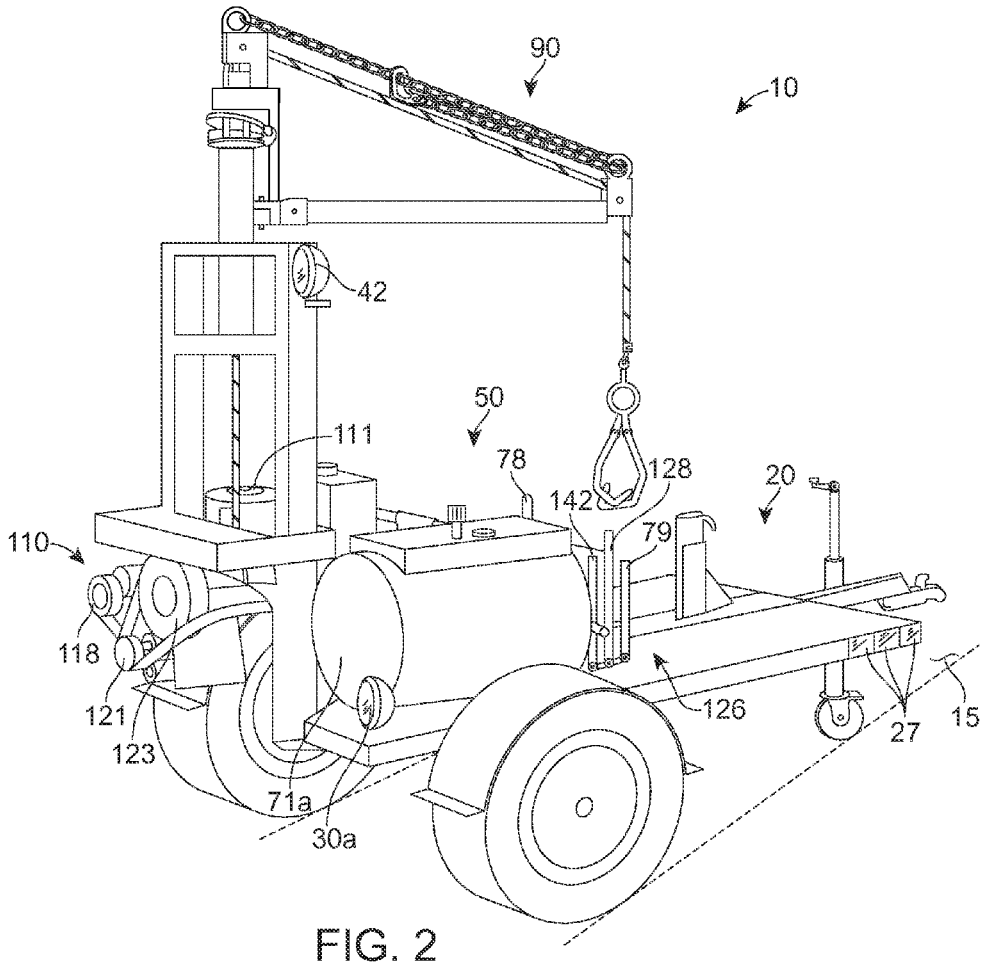
FIG. 2 is a rear perspective view of the trailer-mounted table with wood splitter 10, according to the preferred embodiment.

Referring now to FIG. 1, a front perspective view of the apparatus 10 and FIG. 2, a rear perspective view of the apparatus 10, are disclosed. The apparatus 10 lifts various sizes of wood 17 which are placed onto a widened cutting surface and subsequently splits the wood 17 into smaller pieces. Use of the apparatus 10 enables this process to be completed without the need for repeated heavy manual lifting by an operator as is conventionally associated with similar machines. The apparatus 10 is preferably towed to a desired location by a separate vehicle, such as a truck or all terrain vehicle having expected towing features. The apparatus 10 is approximately four (4) feet wide, twelve (12) feet long, and seven (7) feet high, which allows the apparatus 10 to travel along state and highway roadways.

Figure 3:
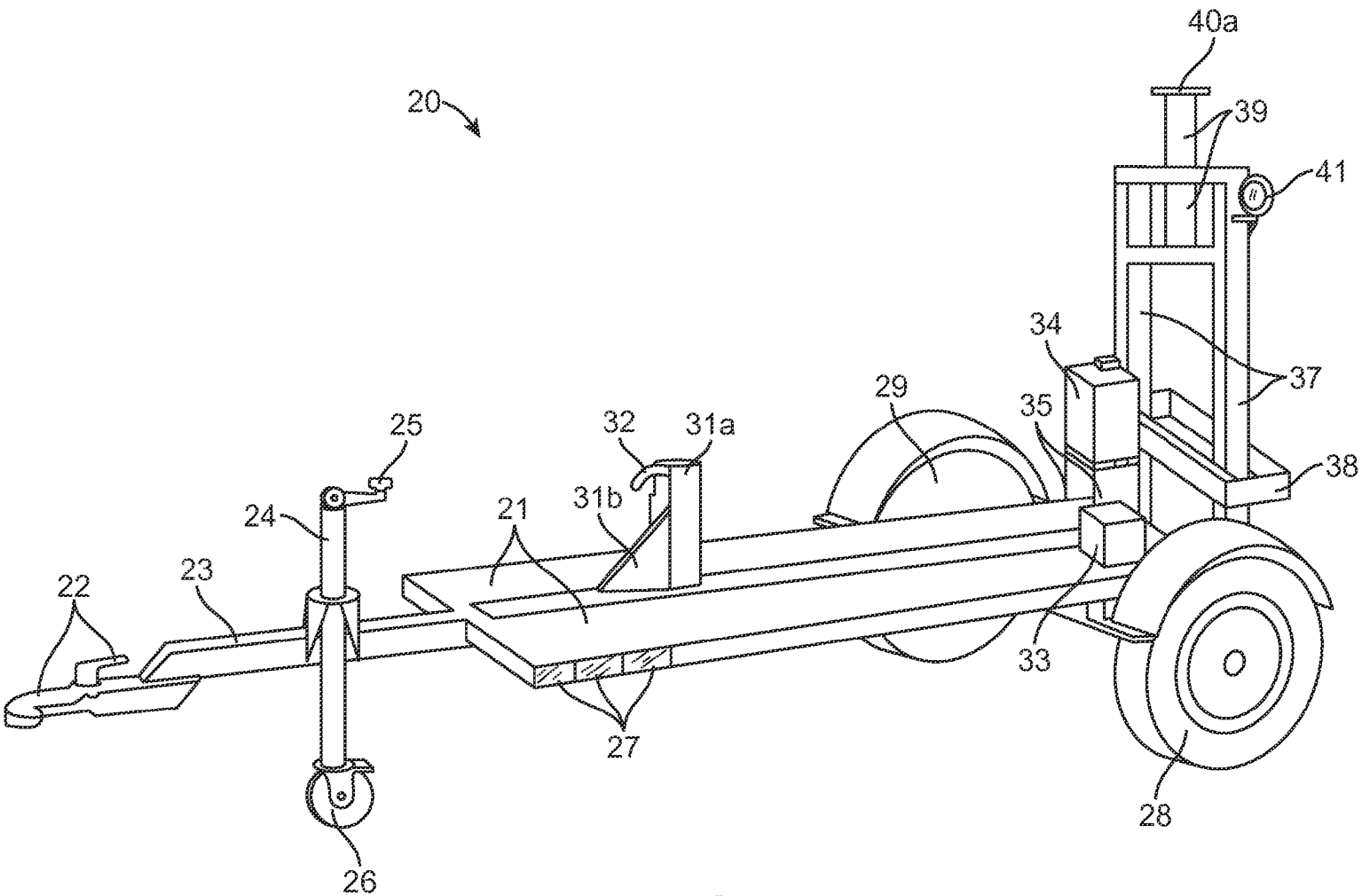
FIG. 3 is a front perspective view of a trailer assembly 20, according to the preferred embodiment.

Referring now to FIG. 3, a front perspective view of the trailer assembly 20, is disclosed. The trailer assembly 20 is intended to be pulled by a vehicle and includes a floor 21, a hitch 22, a trailer jack 24, a first wheel 28, a second wheel 29, a splitter wedge 31*a*, and a supporting structure 37. The trailer assembly 20 is connected to a towing vehicle via a tow hitch 22 which is located on a distal portion of the trailer assembly 20. The hitch 22 is affixed to a tow bar 23 using durable mechanical fastening techniques and engages a receiving tow ball mount which is mounted to the towing vehicle. The hitch 22 extends from the tow bar 23 which is affixed to the floor 21. Along a side surface of the tow bar 23 is a trailer jack 24 which positions the trailer assembly 20 to a desired height when engaging the towing vehicle and when supporting the trainer assembly 20 during storage. The trailer jack 24 includes expected features, such as a crank handle 25 for adjusting the height of the jack 24 and a freely rotatable swivel wheel 26 for contact with the ground surface. The handle 25 lowers and raises the trailer jack 24 and the swivel wheel 26 assists in supporting the trailer assembly 20 during towing.

The floor 21 supports the hydraulic assembly 50, the boom assembly 90, the drive assembly 110, and the winch assembly 126. Each side front surface of the floor 21 includes reflectors 27 which reflect light, such as from oncoming vehicles, to alert nearby vehicles and persons of the apparatus 10. Side rear surfaces of the floor 21 include a first wheel 28 and an opposing parallel second wheel 29 for providing wheeled transportation of the apparatus 10 to a desired location. The wheels 28, 29 preferably include expected features such as, but not limited to: an axle, wheel wells, and the like. The trailer assembly 20 also includes a frame preferably fabricated from a heavy duty steel tube to which the floor 21 is affixed, yet other materials may be utilized without limiting the scope of the apparatus 10.

The stationary splitting wedge 31*a*, utilized for splitting the wood 17, is rigidly mounted to an upper surface of the floor 21. A hydraulic cylinder 51 acts as a ram and forces the wood 17 against the splitting wedge 31*a* to split the wood 17. A rear upper portion of the splitting wedge 31*a* includes a downwardly curved tong hook 32 for retaining a log tong 91 in a stationary and secure position when the log tong 91 is not in use and a lower portion is supported by a wedge brace 31*b*. The splitting wedge 31*a* is preferably fabricated from steel, yet other materials may be utilized without limiting the scope of the apparatus 10.

A battery 33 and a gasoline container 34 are mounted to the upper surface of the floor 21. The battery 34 is preferably a 12-volt direct current (DC) electrochemical cell which sends current to an engine 111, a front light 41, and a rear light 42. The front light 41 and rear light 42 are located on upper side surfaces of a supporting structure 37 and provide a source of illumination during low lighting situations. The gasoline container 34 is mounted to a gasoline platform 35 which is affixed to the floor 21 and provides a secure retainer to removably receive the gasoline container 34. The gasoline platform 35 is a "U"-shaped member attached to a rear end of the floor 21 by welding or similar mechanical fastening techniques. The gasoline container 34 may be strapped onto the gasoline platform 35 with strap fasteners such as bungee cords or straps or may be adhesively attached. The gasoline container 34 retains the fuel needed to power the engine 111 and is preferably fabricated from materials such as, but not limited to: plastic, stainless steel, or the like.

The supporting structure 37 extends upwardly and perpendicularly from the rear end of the floor 21. The supporting structure 37 is generally "U"-shaped and provides support to the boom assembly 90. The supporting structure 37 includes a winch support 38 and a cable guide 39. The winch support 38 is a generally rectangular brace affixed to and surrounding a lower portion of the supporting structure 37 in order to fasten a winch spool 125. The cable guide 39 includes a tubular member which accepts a length of cable 92 routed upwardly from the winch spool 125. The cable guide 39 is located on an upper portion of the supporting structure 37. The cable guide 39 also includes a plate support 40*a* disposed on an upper end which has a pair of notches 40*b* for removably accepting a sloped plate 108. The sloped plate 108 is a component of the boom assembly 90 and will be described in greater detail below. The supporting structure 37 is preferably fabricated from steel or stainless steel, yet other materials may be utilized without limiting the scope of the apparatus 10.

Figure 4:
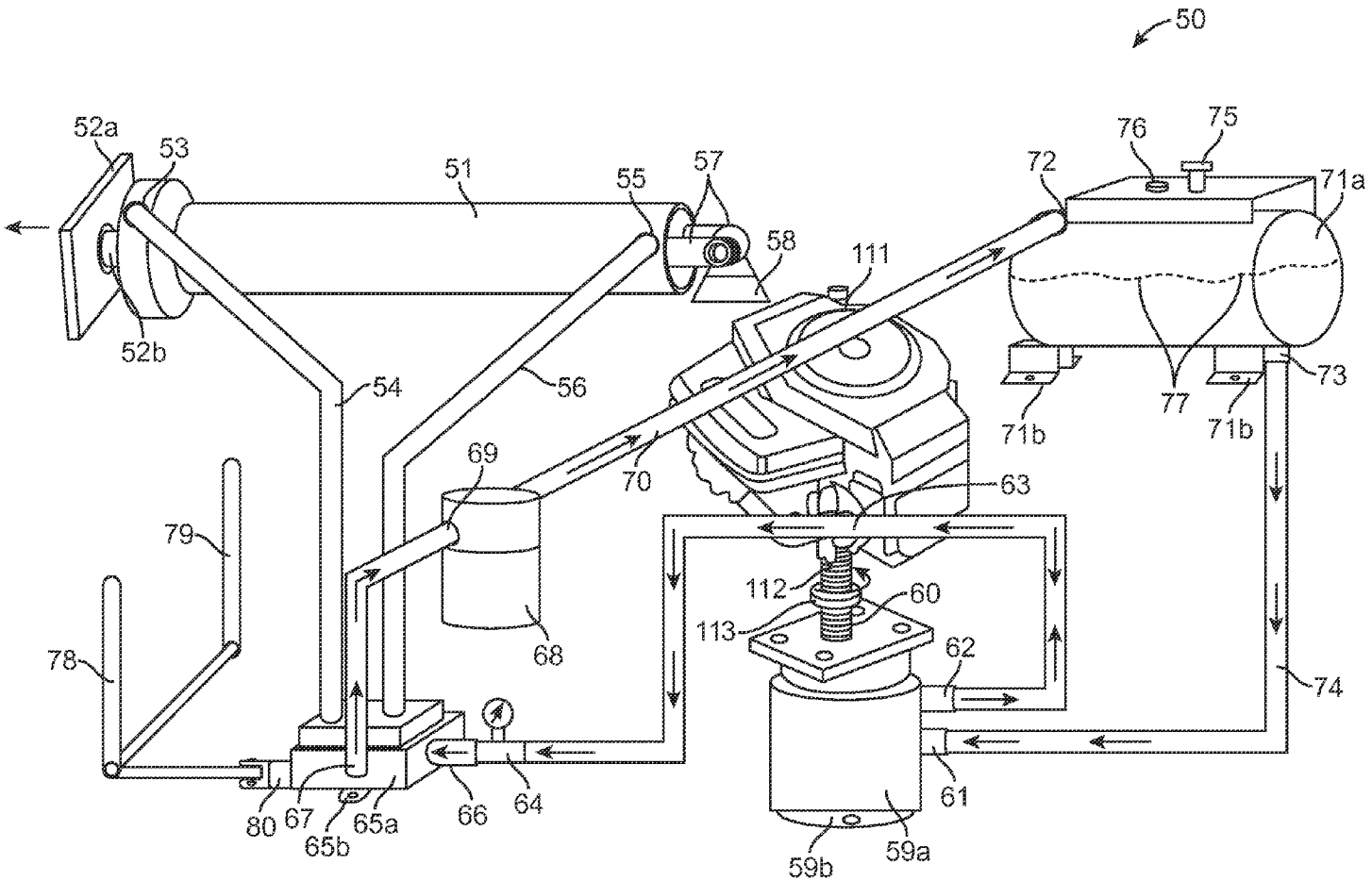
FIG. 4 is a hydraulic diagram of a hydraulic assembly 50, according to the preferred embodiment.

Referring now to FIG. 4, a hydraulic diagram depicting the major components of the hydraulic assembly 50, is disclosed. The hydraulic assembly 50 provides the driving force for splitting the wood 17 against the wedge 31*a*. The hydraulic assembly 50 includes at least a hydraulic cylinder 51, a hydraulic pump 59*a*, a control valve 65*a*, a filter 68, and a tank 71*a*. The hydraulic assembly 50 pumps hydraulic fluid 77 through each of the components and actuation of the hydraulic cylinder 51 is controlled by a first hydraulic lever 78 and a second hydraulic lever 79. The hydraulic cylinder 51 generally includes a cylinder plate 52*a* for contacting the log or similar piece of wood and an internal piston 52*b* for driving and returning the cylinder plate 52*a*. A forward port 53, a forward hydraulic line 54, a rearward port 55, a rearward hydraulic line 56 provide for a working fluid flow in to and out from the hydraulic cylinder 51. A clevis 57 and a cylinder mount 58 affix the hydraulic cylinder 51 to the floor 21 of the trailer assembly 20. The hydraulic cylinder 51 preferably has a five (5) inch diameter bore, similar to hydraulics used on bulldozers or other heavy equipment; yet other sizes may be utilized without limiting the scope of the apparatus 10.

The cylinder plate 52*a* is rigidly affixed to a driving end of the piston 52 which provides a reciprocating linear motion with respect to the hydraulic cylinder 51. The cylinder plate 52*a* contacts the wood 17 when the piston 52*b* is extended and rams the wood 17 against the splitting wedge 31*a* to split into smaller more useful pieces of wood. The clevis 57, which is attached to the cylinder mount 58, is disposed at an opposing end of the hydraulic cylinder. The cylinder mount 58 is preferably rigidly affixed to the floor 21 via mechanical fasteners or welding. The forward hydraulic line 54 is fitted to the forward port 53 for entering hydraulic fluid 77 to be forced through in order to retract the piston 52*b* and coincidentally the cylinder plate 52*a*. The rearward hydraulic line 56 is fitted to the rearward port 55 for entering hydraulic fluid 77 to be forced through to extend the piston 52*b* and coincidentally the cylinder plate 52*a*.

The hydraulic fluid 77 is forced into the forward port 53 or the rearward port 55 by the hydraulic pump 59*a*. The hydraulic pump 59*a* is powered by the engine 111, such that the drive shaft 112 is affixed to a pump shaft 60 of the hydraulic pump 59*a* to transfer rotational motion therebetween. The hydraulic pump 59*a* is attached to the floor 21 of the trailer assembly 20 by a pump mount 59*b* and mechanical fasteners. The hydraulic pump 59*a* is preferably a two (2) stage high volume, high pressure pump with a rated pressure of three-thousand (3000) psi, yet other pumps may be utilized without limiting the scope of the apparatus 10. Hydraulic fluid 77 is directed into the pump inlet 61 which is attached to and in fluid communication with the tank outlet 73 by a tank line 74. Once the hydraulic fluid 77 flows into the hydraulic pump 59*a* it is then directed to a pressure gauge 64 through a pump line 63 connected to the pump outlet 62. The gauge 64 depicts the amount of pressure going into the control valve 65*a* which may be adjusted to a desired pressure. The control valve 65*a* enables an operator to manually control the flow of hydraulic fluid 77 and concurrently the action of the hydraulic cylinder 51. The control valve 65*a* is actuated by the first hydraulic lever 78 and the second hydraulic lever 79 which are located on opposing sides of the trailer assembly 20, thereby enabling the operator to control the hydraulic assembly 50 from either side of the trailer assembly 20. An outward pull of a hydraulic lever 78, 79 will cause hydraulic fluid 77 to flow into the rearward hydraulic line 56 and extend the piston 52*b*. Releasing the hydraulic levers 78, 79 will cause hydraulic fluid 77 to flow into the forward hydraulic line 54 and retract the piston 52*b*. Each hydraulic lever 78, 79 is preferably fabricated from steel or similar material.

The control valve outlet 67 is connected to a filter 68 through a filter inlet line 69. The filter 68 removes any debris or impurities that may be in the hydraulic fluid 77 before being directed back into the tank 71*a* through a filter outlet line 70 connected to a tank inlet 72. The tank 71*a* is mounted to the floor 21 of the trailer assembly 20 by a plurality of tank mounts 71*b* which are fastened to the floor 21 by mechanical fasteners or welding. The tank 71*a* is refillable through use of a tank port 76 and air vents from within the tank 71*a* through a tank valve 75. The tank 71*a* preferably has a capacity of approximately twenty (20) gallons of hydraulic fluid 77, yet other capacities may be utilized without limiting the scope of the apparatus 10.

Figure 5:
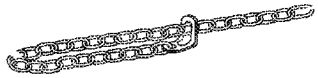
FIG. 5 is a side view of a boom assembly 90, according to the preferred embodiment.
Figure 5:
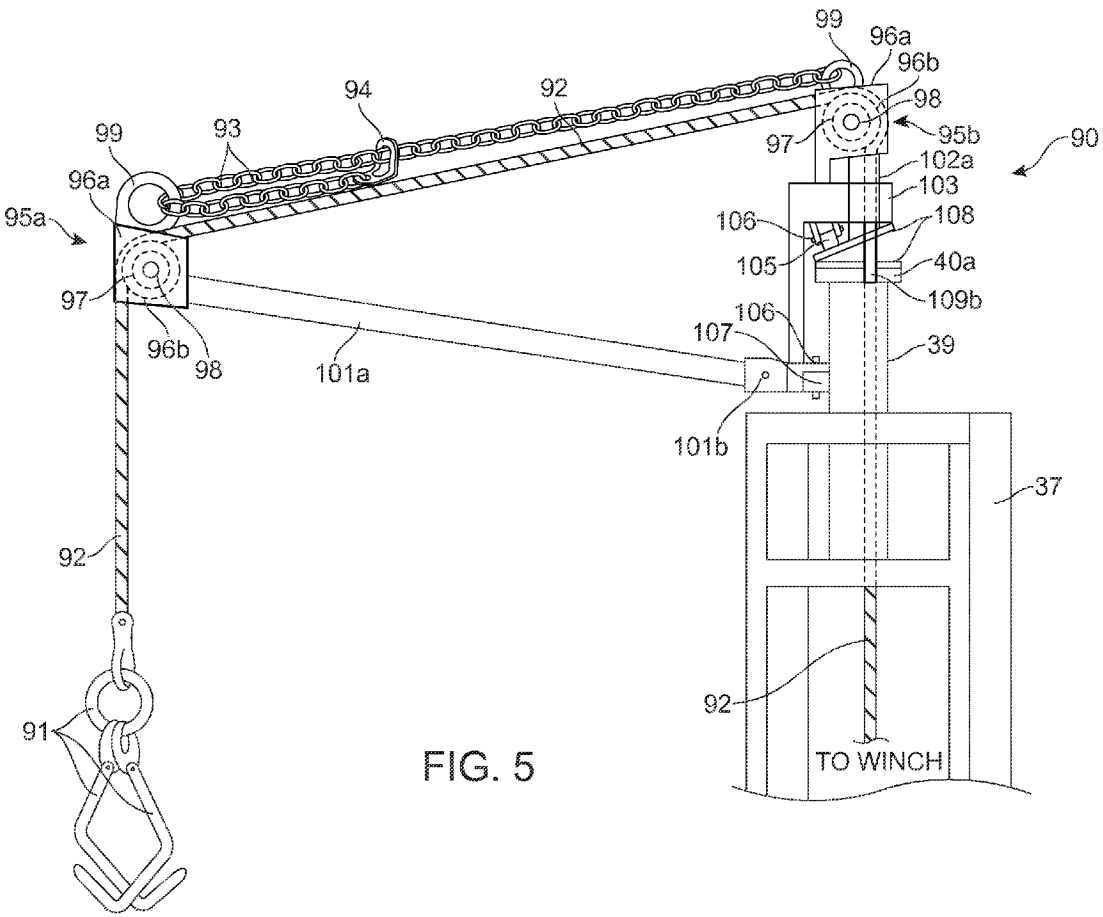
Figure 6:
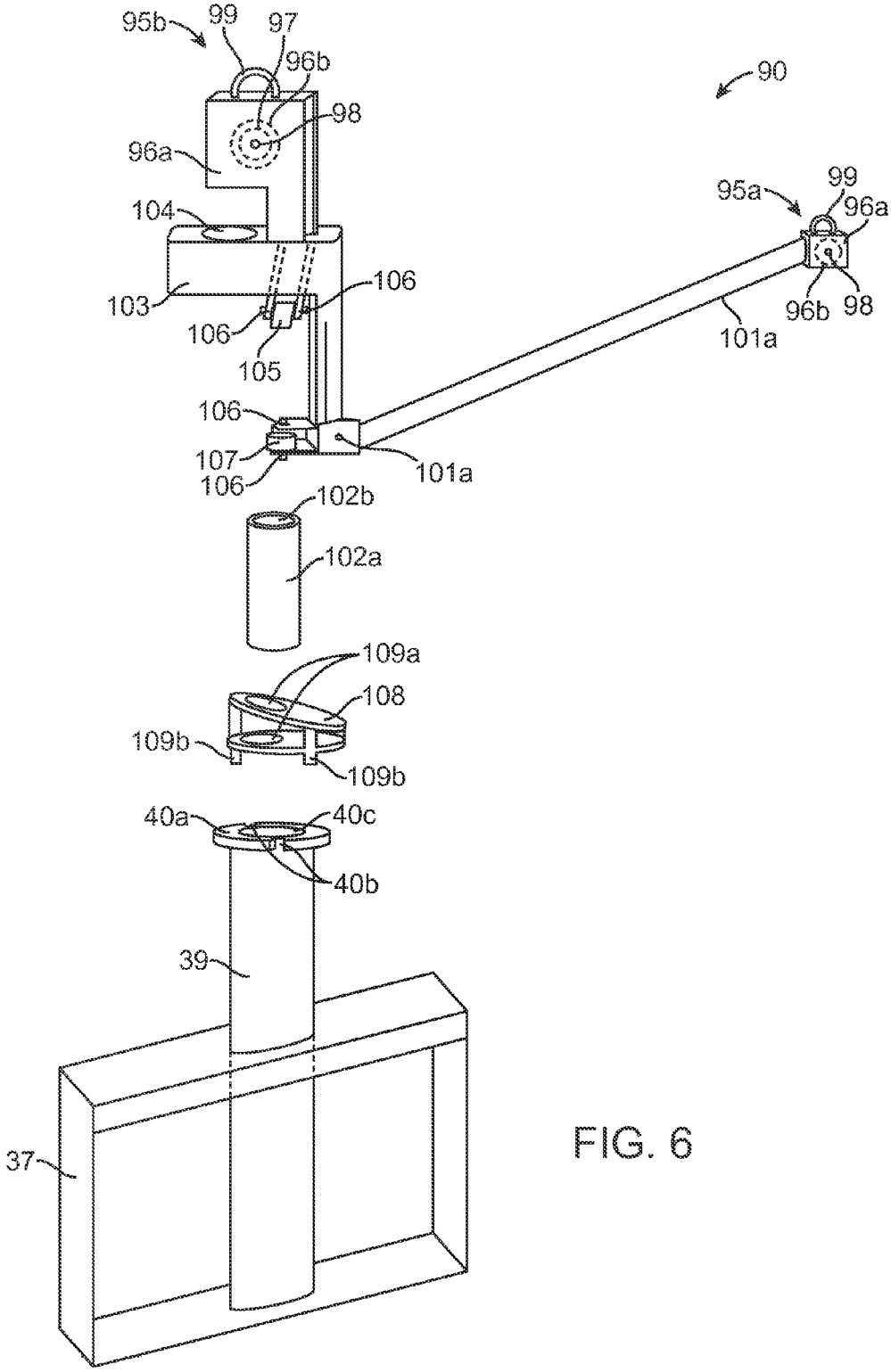
FIG. 6 is an exploded view of the boom assembly 90, according to the preferred embodiment.
Figure 7:
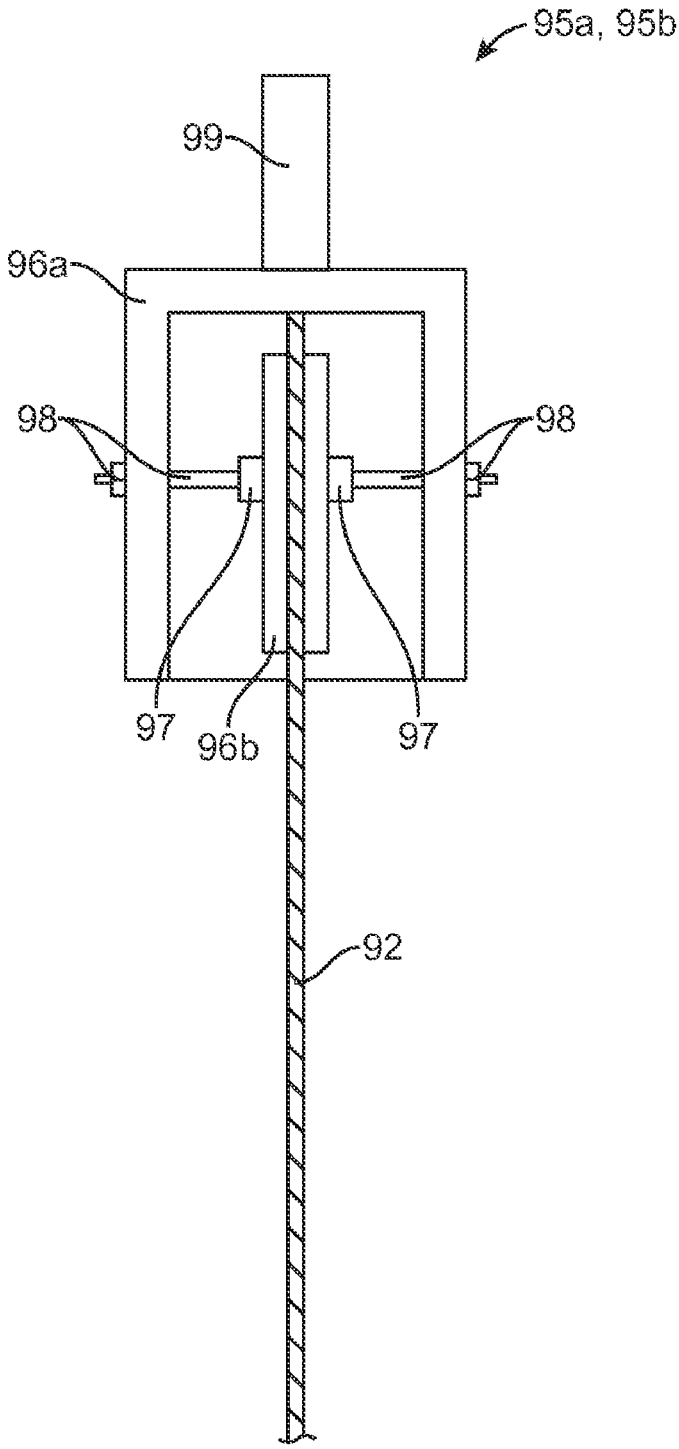
FIG. 7 is a front view of a pulley assembly 95*a* and 95*b*, according to the preferred embodiment.

Referring now to FIG. 5, a side view of the boom assembly 90, FIG. 6 an exploded view of the boom assembly 90, and FIG. 7 a front view of a cable enclosure 95, are disclosed. The adjustable boom assembly 90 enables the operator to secure the wood 17 and lift and position it upon the floor 21 of the trailer assembly 20 or to another desired location, thereby eliminated the need for the operator from taking part in repeated heavy lifting. The boom assembly 90 generally includes a log tong 91, a length of cable 92, a length of chain 93, a pair of cable enclosures 95*a*, 95*b*, and a boom 101*a*. The boom assembly 90 is preferably fabricated from steel, yet other materials may be utilized without limiting the scope of the apparatus 10.

The boom assembly 90 mounts to the supporting structure 37 at the plate support 40*a* atop the cable guide 39. A pair of notches 40*b* is located along opposing upper perimeter edges of the plate support 40*a*. The pair of notches 40*b* engages a pair of extensions 109*b* which extend downwardly from a bottom of the slope plate 108. The slope plate 108 includes a lower horizontal member, which mates with a top of the plate support 40*a*, and a downwardly angled upper member, which urges the boom assembly 90 to be self-centering to the front or rear of the trailer assembly 20. The boom assembly 90 rests atop of the downwardly angled upper member of the slope plate 108 and due to the downward angle of the slope plate 108 the boom assembly 90 will always travel to the lowest point on the slope plate 108, thereby centrally positioning the boom assembly 90. The extensions 109*b* may engage the notches 40*b* as desired by the operator for positioning and centering the boom assembly 90 toward the front or the rear of the trailer assembly 20 in order to enable the boom 101*a* be angled over the trailer assembly 20 or angled behind the trailer assembly 20. With the boom assembly 90 angled at the rear of the trailer assembly 20, the apparatus 10 can lift and reposition wood 17 that is located behind the apparatus 10. The orientation of the boom assembly 90 is reversed by lifting upwardly on the boom assembly 90 and rotating the slope plate 108 one-hundred-and-eighty degrees (180°).

The sloped plate 108 also includes a pair of parallel slope plate apertures 109*a* which are also parallel to a cable guide aperture 40*c*. The slope plate apertures 109*a* are of an appropriate diameter to accept a pipe 102*a*. A lower portion of the pipe 102*a* is inserted into the slope plate apertures 109*a* and an upper portion of the pipe 102*a* is inserted into a cable aperture 104 on a boom attachment 103, thereby enabling the cable 92 to be guided through the pipe 102*a*, sloped plate 108, and cable guide 39 to the winch spool 125. The pipe 102*a* is preferably sized to fit within the upper aperture of the cable guide 39 and rest upon an interior lip or tapered interior sidewalls.

A distal end of the boom 101*a* includes a front pulley assembly 95*a* and an upper end of the boom attachment 103 includes a rear pulley assembly 95*b* which combine to route the cable 92 from the winch spool 125 to the log tong 91. The boom attachment 103 generally includes an "L"-shaped member and positions the boom 101*a* on the vertical axis and provides for rotation of the boom 101*a* along the horizontal axis about the pipe 102*a* and slope plate 108. A lower, inside vertical end of the boom attachment 103 includes a vertical roller 107, which is attached to the boom attachment 103 by a pair of roller brackets 106 positioned on each outer side surface of the vertical roller 103. In use, the vertical roller 103 engages an outer surface of the cable guide 39 to provide horizontal rotation support for the boom assembly 90. Opposing the vertical roller 107 is the boom 101*a* which extends outwardly from the lower end of the boom attachment which extends and supports the suspended log tong 91. A horizontal inner surface of the boom attachment 103 includes a horizontal roller 105 which is attached to the boom attachment 103 by a pair of roller brackets 106 positioned on each outer side surface of the horizontal roller 105. The horizontal roller 105 engages the downwardly angled upper surface of the slope plate 108, which provides for the self-centering of the boom 101*a*.

The boom 101*a* is made of a tubular member supported within a clevis bracket on the outside lower end of the boom attachment 103 and is pivotally attached by a pivot pin 101*b*. The incline of the boom 101 is controlled by adjusting the length of a chain 93 by a chain lock link 94. The chain 93 is affixed at one end to a rear chain loop 99 located atop the rear pulley assembly 95*b* and looped through a front chain loop 99 located atop the front pulley assembly 95*a* and secured to an intermediate location on the chain length. The chain lock link 94 is affixed to the free end of the chain 93 and includes a curved body having a center aperture for hooking over a single link of the chain 93.

The front pulley assembly 95*a* is rigidly attached to the boom 101*a*, preferably by welding, and the rear pulley assembly 95*b* is rigidly attached to the boom attachment 103, preferably by integrally molded parts or welding. Each pulley assembly 95*a*, 95*b* includes a cable enclosure 96*a*, a roller 96*b*, a bushing 97, a pin 98. The cable enclosure 96*a* is a generally rectangular housing with an open front surface and open rear surface for the cable 92 to be routed through. The roller 96*b* is positioned at an intermediate position within the cable enclosure 96*a* and includes an inwardly arcuate circumferential edge to retain and guide the cable 92. The bushing 97 is an independent plain bearing preferably made of a brass sleeve, yet other materials may be utilized, and provides a bearing surface for rotational movement about and attachment to the pin 98. The pin 98 is preferably welded to opposing outer surfaces of the cable enclosure 96*a* such that the bushing 97 and roller 96*b* can freely rotate upon the pin 98. Each cable enclosure 96*a* is preferably fabricated from steel, yet other materials may be utilized without limiting the scope of the apparatus 10.

Figure 8:
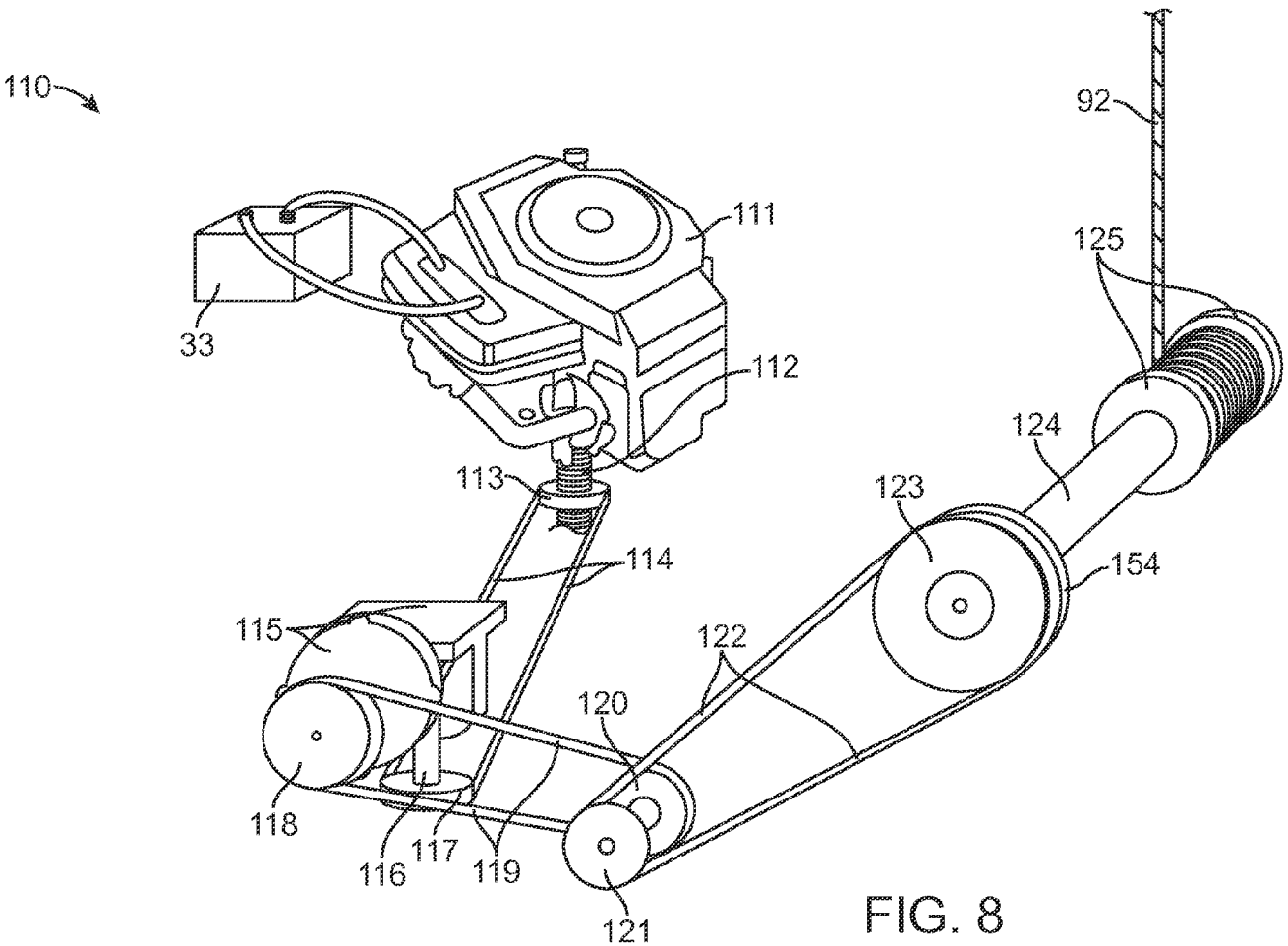
FIG. 8 is a mechanical schematic of a drive assembly 110, according to the preferred embodiment.

Referring now to FIG. 8, a mechanical schematic depicting the major components of the drive assembly 110, is disclosed. The drive assembly 110 is mechanically operated by an engine pulley 113 which is rigidly attached to an end of the drive shaft 112. The engine 111 is preferably a vertical shaft internal combustion engine having approximately sixteen (16) horsepower and a key started ignition assembly, yet other motor drives may be utilized without limiting the scope of the apparatus 10.

An inner diameter of the engine pulley 113 is appropriately sized to mate with the outer diameter of the vertical drive shaft 112. An engine pulley belt 114 engages the around the engine pulley 113. The engine pulley belt 114 is also connected to a transmission 115 by a transmission input pulley 117 attached to a transmission shaft 116. An inner diameter of the transmission input pulley 117 is appropriately sized to mate with the outer diameter of the transmission shaft 116, thereby enabling the transmission input pulley 117 to operate the transmission 115. The transmission shaft 116 is illustrated as being located on a bottom surface of the transmission 115, yet other location may be utilized without limiting the scope of the apparatus 10. The transmission 115 preferably provides an eighty-to-one (80:1) speed reducing ratio, yet other speed reducing gear boxes may be utilized without limiting the scope of the apparatus 10. The transmission 115 is preferably secured to a side surface of the supporting structure 37; however, it can be appreciated that other locations may be utilized without limiting the scope of the apparatus 10. The transmission 115 is rigidly mounted to the supporting structure 37 by mechanical fasteners or welding. The transmission 115 also includes a transmission output pulley 118 extending outwardly which provides a rotational drive to the winch spool 125. The transmission output pulley 118 is preferably a five inch (5") diameter pulley, yet other dimensions may be utilized without limiting the scope of the apparatus 10. The transmission output pulley 118 is illustrated as being located on a side surface of the transmission 115, yet other location may be utilized without limiting the scope of the apparatus 10. The transmission output pulley 118 drives a drive pulley 120 by a transmission belt 119. The drive pulley 120 is rigidly connected to a friction pulley 121 by a spacer shaft. The drive pulley 120 and the friction pulley 121 are each preferably a four inch (4") diameter pulley, yet other dimensions may be utilized without limiting the scope of the apparatus 10. The drive shaft pulley 120 and the friction pulley 121 rotatably mounted to a pulley shaft which is rigidly affixed to a rear portion of the supporting structure 37. A winch belt 122 is connected between the friction pulley 121 and a winch pulley 123. The winch pulley 123 is rigidly connected to the winch spool 125 by a winch shaft 124. Rotation of the friction pulley 121 rotates the winch spool 125 for extending or retracting the cable 92 and thus the log tong 91. In the preferred embodiment, the winch shaft 124 is rotatably mounted to the winch support 38 on the lower outside end of the support structure 37. The winch shaft 124 is preferably a one inch (1") cold-rolled shaft and the winch spool 125 is preferably a four inch (4") spool mounted to the winch support 38. The winch spool 125 holds approximately sixty feet (60') of cable 92. The belts 114, 119, 122 are drive belts appropriately sized to correspond to the pulleys 113, 117, 118, 120, 121, 123.

Figure 9B:
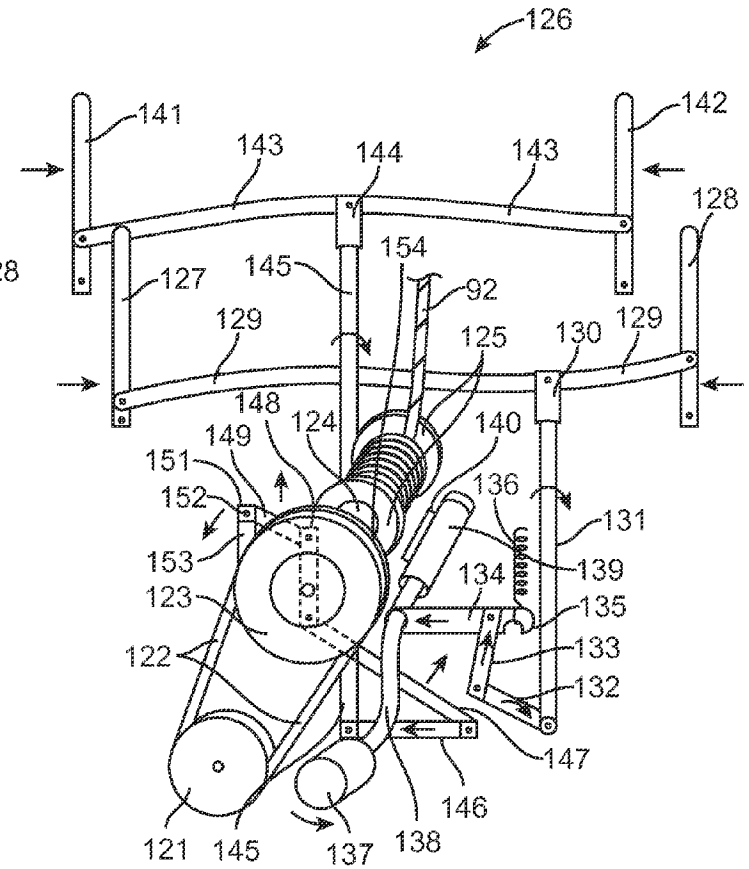
FIG. 9*b* is functional diagram of the winch assembly 126, according to the preferred embodiment; and, FIG. 10 is an electrical block diagram of the trailer-mounted table with wood splitter 10, according to the preferred embodiment.
Figure 9A:
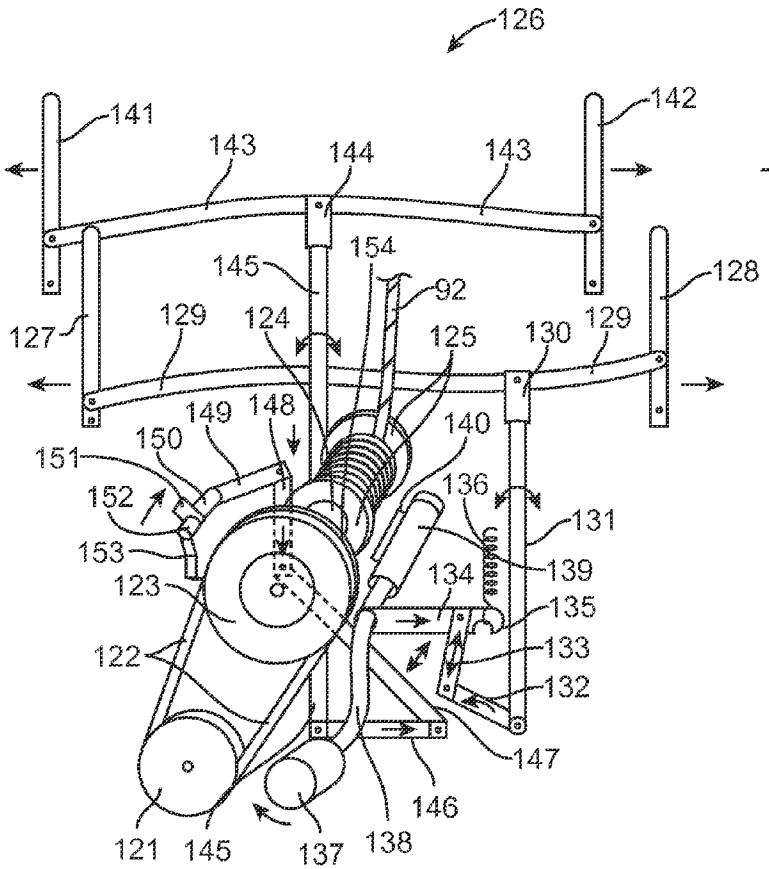
FIG. 9*a* is a functional diagram of a winch assembly 126, according to the preferred embodiment.

Referring now to FIG. 9*a* and FIG. 9*b*, functional diagrams depicting the major functional components of the winch assembly 126, are disclosed. The winch assembly 126 is illustrated with associated components of the apparatus 10 removed for illustration purposes only and it is known the associated components would be incorporated during manufacturing as a finishing product. The winch assembly 126 provides for activation and control of the winch spool 125 and allows the operator to control the length of cable 92 being unwound from and wound to the winch spool 125. The winch assembly 126 includes a braking mechanism which prohibits rotational movement of the winch spool 125 and restricts the cable 92 from unwinding or winding. The winch assembly 126 also includes a pair of manually operated controls on either side of the trailer assembly 20 for actuating rotation of the winch spool 125 and engaging the braking mechanism. Control of the winch spool 125 is provided by a first engaging lever 127 and a second engaging lever 128 and control of the braking mechanism is provided by a first brake lever 141 and a second brake lever 142. The engaging levers 127, 128 and the brake levers 141, 142 are depicted as being located in parallel on opposing sides of the trailer assembly 20 for illustration purposes only. The engaging levers 127, 128 and the brake levers 141, 142 are preferably orientated in a criss-crossed manner to maintain a consistent right- or left-handed orientation regardless of which side of the trailer assembly 20 the operator is located. Each of the engaging levers 127, 128 are pivotably connected to an engaging lever link 129. Each of the braking levers 141, 142 are pivotably connected to a braking lever link 143. The engaging lever link 129 and the braking lever link 143 each include an offset mechanical link and cross one another, such that the engaging levers 127, 128 and the braking levers 141, 142 will be in the same location relative to each other on both sides of the trailer assembly 20.

The engaging levers 127, 128 control the length of cable 92 by pivoting an engagement roller 137 into contact with the winch belt 122 in order to provide sufficient tension on the winch belt 122 for the friction pulley 121 to drive the winch pulley 123. The engaging levers 127, 128 are oriented in an upright manner and pivotably attached to the surface of the floor 21 at an intermediate position of the trailer assembly 20 and are pulled outwardly to disengage the engaging roller 137 and release cable 92 and pushed inwardly to engage the engaging roller 137 and retract the cable 92. The engaging levers 127, 128 and the engaging lever link 129 are preferably fabricated from steel, yet other materials may be utilized without limiting the scope of the apparatus 10. The engaging roller 137 is mechanically linked to the engaging levers 127, 128 through a plurality of mechanical links pivotably attached to one another which translates the inwardly or outwardly movement of the engaging levers 127, 128 to motion of the engaging roller 137.

In the preferred embodiment, the engaging levers 127, 128 are connected to an engaging tie rod 131 by an engaging tie rod attachment 130 which is fastened to the engaging lever link 129. The engaging tie rod attachment 130 is pivotably attached to the engaging lever link 129 and the engaging tie rod 131 by nuts and bolts, yet other fasteners may be utilized without limiting the scope of the apparatus 10. Inwardly or outwardly vertical movement of the engaging levers 127, 128 concurrently causes the engaging tie rod 131 to rotate clockwise or counterclockwise, respectively. Further, the rotation of the engaging tie rod 131 rotates a first engaging link 132 in a clockwise or counterclockwise manner in relation to the inwardly or outwardly movement of the engaging levers 127, 128. A distal end of the first engaging link 132 is pivotably attached to the engaging tie rod 131 by fasteners and the first engaging link 132 is positioned in an angled orientation perpendicular to the engaging tie rod 131 at a rear portion of the trailer assembly 20. The first engaging link 132 is pivotably attached to a second engaging link 133 on a proximal end by fasteners. Rotation of the first engaging link 132 pulls the second engaging link 133 downwardly or pushes the second engaging link 133 upwardly in relation to the movement of the engaging levers 127, 128. The second engaging link 133 is positioned in an upright orientation and is pivotably attached at a proximal end to a third engaging link 134 by fasteners. The third engaging link 134 is positioned perpendicularly to the second engaging link 132 and provides an attachment to a spring 136 and a roller arm 138. The spring 136 is attached to a distal arcuate end of the third engaging link 134 and to the supporting structure 37 and provides a tension to the engaging levers 127, 128 and provides an automatic return of the roller arm 138 and engaging roller 137 to an unengaged position. A proximal end of the third engaging link 134 is pivotably attached to the roller arm 138 by fasteners. Motion of the third engaging link 134 provides for a rotating motion of the roller arm 138. The engaging roller 137 is affixed to an end of the roller arm 138 and moves in a clockwise or counterclockwise direction with respect to the inwardly and outwardly movement of the engaging levers 127, 128. Movement of the roller arm 138 engages the engaging roller 137 to the winch belt 122. When the engaging roller 137 oriented away from the winch belt 122, the winch belt 122 is not engaged with the friction pulley 121 or the winch pulley 123; thus the winch spool 125 freely rotates and unwinds cable 92. When either of the engaging levers 127, 128 are actuated, the engaging roller 137 is oriented toward and abuts against the winch belt 122 which engages the winch belt 122 to the friction pulley 121 and the winch pulley 123; thus the winch spool 125 is driven by the drive assembly 110 and rotates and winds cable 92.

The roller arm 138 is pivotably attached by being insertingly secured within a roller sleeve 139 which allows the roller arm 138 and engaging roller 137 to rotate with respect to the roller sleeve 139. A side surface of the roller sleeve 130 includes a roller sleeve attachment 140 which tangentially protrudes from an exterior surface and is affixed to the supporting structure 37. The links 132, 133, 134, the engaging roller 137, and the roller arm 138 are preferably fabricated from steel, yet other materials may be utilized without limiting the scope of the apparatus 10.

The braking mechanism provides restriction to the rotational motion of the winch spool 125 and halts the dispensing or retracting of cable 92 by engaging a brake pad 153 to the winch pulley 123. The winch spool 125 is locked in position by actuating the first brake lever 141 or the second brake lever 142. The brake levers 141, 142 are substantially similar to the engaging levers 127, 128 in location and materials. The brake levers 141, 142 are oriented in an upright manner and pivotably attached to the surface of the floor 21 at an intermediate position of the trailer assembly 20 adjacent to the engaging levers 127, 128 and are pulled outwardly to engage the brake mechanism and pushed inwardly to disengage the brake mechanism. The brake levers 141, 142 and brake lever link 143 are preferably fabricated from steel, yet other materials may be utilized without limiting the scope of the apparatus 10. The brake pad 153 is mechanically linked to the braking levers 141, 142 through a plurality of mechanical links pivotably attached to each other which translates the inwardly or outwardly movement of the braking levers 127, 128 to motion of the brake pad 153.

In the preferred embodiment, the brake levers 141, 142 are connected to a brake tie rod 145 by a brake tie rod attachment 144 fastened to the brake lever link 143. The brake tie rod attachment 144 is pivotably attached to the brake lever link 143 and the brake tie rod 145 by nuts and bolts or similar mechanical fasteners. The inwardly or outwardly vertical movement of the brake levers 141, 142 concurrently causes the brake tie rod 145 to rotate clockwise or counterclockwise, respectively. Rotation of the brake tie rod 145 rotates a first brake link 146 in a clockwise or counterclockwise manner in relation to the inwardly or outwardly movement of the brake levers 141, 142. A distal end of the first brake link 146 is pivotably attached to the brake tie rod 145 by fasteners and the first brake link 146 is positioned in a horizontal orientation perpendicular to the brake tie rod 145 at a rear portion of the trailer assembly 20. As the brake tie rod 145 rotates the first brake link 146 moves in a horizontal direction. A proximal end of the first brake link 146 is pivotably attached to a second brake link 147 by fasteners and causes the second brake link 147 to move upwardly and downwardly at an angle. The second brake link 147 is located behind the winch pulley 123 and is further pivotably attached to a third brake link 148 which causes an upward and downward movement of the third brake link 148. The third brake link 148 is pivotably attached to a fourth brake link 149 oriented at a downward angle. The brake links 146, 147, 148, 149 are rectangular and preferably fabricated from steel, yet other materials may be utilized without limiting the scope of the apparatus 10. The brake links 146, 147, 148, 149 provide for rotation of the brake mechanism which places the brake pad 153 in contact with a braking groove 154 on the winch pulley 123. Braking of the winch pulley 123 prevents rotation of the winch spool 125.

A tubular shaft bushing 150 is fixed to an upper surface of the supporting structure 37 and enables an attachment of the fourth brake link 149 to a pivot bracket 151 via an internal shaft routed through the shaft bushing 150. As the fourth brake link 149 rotates it concurrently rotates the pivot bracket 151. An attachment sleeve 152 is clamped to the pivot bracket to secure and retain attachment of one end of the brake pad 153. An opposing end of the brake pad 153 is secured to the support structure 37 adjacent to the winch support 38, such that the brake pad 153 is routed underneath and around the winch pulley 123 within the braking groove 154. The brake pad 153 is preferably fabricated from a metal strap or a wired mesh material coated in rubber. Inwardly and outwardly movement of the brake levers 141, 142 pivots the pivot bracket 151 and draws up the attached end of the brake pad 153, thereby putting tension upon the bake pad 153 and engaging the braking groove 154. In use, either of the brake levers 141, 142 are pulled outwardly to engage the brake pad 153 and stop the winch pulley 123 or are pushed inwardly to disengage the brake pad 153 from the winch pulley 123. It is understood that other braking mechanisms may be used with equal benefit utilizing the same or similar mechanical links to translate inwardly or outwardly movement of the braking levers 127, 128 to engage a brake pad or braking clamp to the winch pulley 123.

Figure 10:
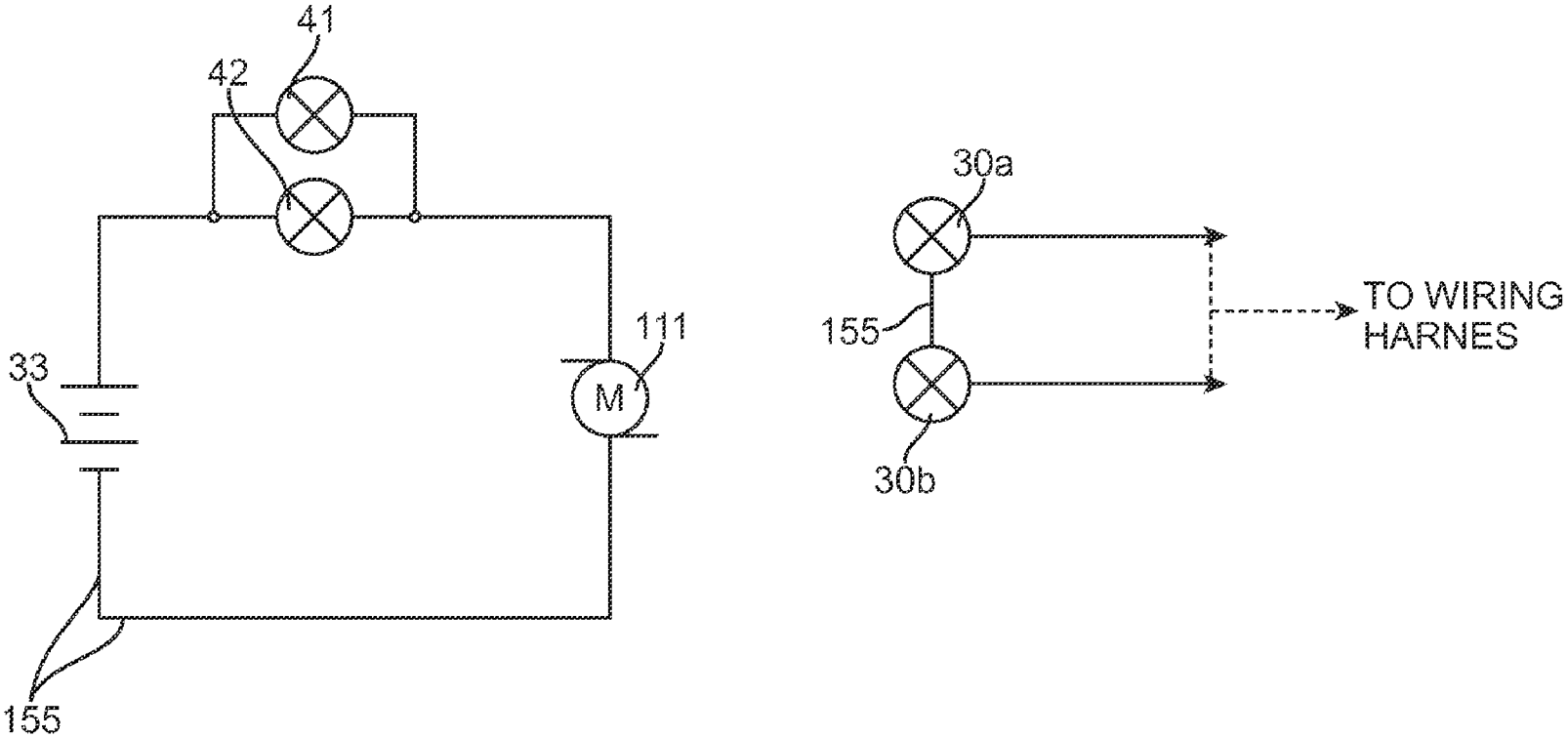

Referring now to FIG. 10, an electrical block diagram depicting the major electrical components of the apparatus 10, is disclosed. The brake lights 30*a*, 30*b* are located on a rear portion of the trailer assembly 20 and are preferably interconnected to the wiring harness by electrical wiring 155 to the towing vehicle in a conventional manner. The brake lights 30*a*, 30*b* alert motorist who are behind the apparatus 10 that the towing vehicle is slowing down or coming to a stop.

The battery 33 is interconnected to the lights 41, 42 and the engine 111 via appropriately gauged electrical wiring 155. Current is sent through the wiring 155 to the lights 41, 42 to illuminate the lights 41, 42 and to activate the engine 111. Although illustrated herein as being depicted in this fashion it is understood that other configurations of the electrical components of the apparatus 10 may be utilized without limiting the scope of the apparatus 10.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIGS. 1 and 2.

The method of transporting the apparatus 10 may be achieved by performing the following steps: acquiring the apparatus 10; utilizing the trailer jack 24 to position the trailer assembly 20 onto an existing vehicle; positioning the hitch 22 upon an existing tow-ball and fastening; connecting the trailer assembly 20 to the vehicles wiring harness in a conventional manner; enabling the vehicle to tow the apparatus 10 to a desired location; and, detaching the apparatus 10 from the towing vehicle as necessary.

The method of utilizing the apparatus 10 may be achieved by performing the following steps: starting the engine 111; pulling the engaging lever 127, 128 to release the cable 92 to a desired length; positioning the log tongs 91 onto a piece of wood 17; applying the brake via pulling the brake lever 141, 142 outwardly, thereby engaging the brake pad 153 to the winch pulley 123; pushing the engaging lever 127, 128 to wind the cable 92 and suspend the wood 17; directing the wood 17 over the trailer assembly 20 between the splitter wedge 31*a* and hydraulic cylinder 51; releasing the brake via pushing the brake lever 141, 142 and pulling the engaging lever 127, 128 to release the cable 92, thereby dropping the wood 17 onto the floor 21; removing the log tongs 91 from the wood 17; pulling the hydraulic lever 78, 79 outwardly to extend the piston 52*b* and engage the cylinder plate 52*a* against the wood 17, thereby pushing the wood 17 toward the splitter wedge 31*a*; releasing the hydraulic lever 78, 79 to retract the piston 52*b*; removing the split wood 17 from the floor 21 of the trailer assembly 20 as desired; repeating as necessary; and utilizing the apparatus 10 to conveniently split wood 17.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A trailer-mounted table wood splitting apparatus comprising:

a trailer assembly comprising a frame for structural support, a floor affixed to said frame for supporting operational assemblies, a tow assembly affixed to a distal end of said frame for removable connection to a tow vehicle, and a pair of wheel assemblies attached to opposing sides of said frame;

a splitter wedge rigidly affixed on said floor disposed toward a front end having a pair of sloped surfaces facing a rear end of said trailer assembly for splitting wood forced against said splitter wedge;

a hydraulic assembly comprising a hydraulic cylinder mounted to said floor and aligned with said splitter wedge for forcing wood against said splitter wedge, a hydraulic pump for driving said hydraulic cylinder, a hydraulic control valve in fluid communication between said hydraulic pump and said hydraulic cylinder for controlling actuation of said hydraulic cylinder, and a hydraulic fluid storage tank in fluid communication with said hydraulic pump;

a boom assembly comprising a supporting structure affixed to said trailer assembly rear end, a boom pivotably mounted atop said supporting structure and extending laterally therefrom, a pair of pulley assemblies disposed on opposing ends of said boom, and a lifting cable routed through said pair of pulley assemblies and terminating at a log tong for lifting and placement of wood;

a winch assembly comprising a winch spool affixed to an end of said lifting cable opposite said log tong for winding up and winding out said lifting cable, a winch shaft affixed through said winch spool and rotatably mounted to said supporting structure, and a winch pulley rigidly affixed to an end of said winch shaft for cranking said winch spool;

a drive assembly comprising an engine having a rotating drive shaft and an engine pulley affixed to said drive shaft, a transmission for providing speed and torque conversion of said drive shaft having an input pulley in mechanical communication with said engine pulley by an engine pulley belt and an output pulley in mechanical communication with a drive pulley by a transmission belt, and a friction pulley rigidly connected to said drive pulley and in mechanical communication with said winch pulley by a winch belt;

a winch drive control mechanism comprising an engaging roller selectively engaged into pressure contact with a slack side of said winch belt from an outside position, an elongated off-set roller arm affixed to said engaging roller and rotatably connected to said supporting structure, at least one engaging lever for selectively engaging said engaging roller into pressure contact with said slack side of said winch belt, and at least one engaging link member pivotably attached to and for mechanical communication between said roller arm and said at least one engaging lever; and, a braking mechanism comprising a brake pad selectively engaged into pressure contact with said winch pulley, a bracket connected to said brake pad, at least one brake lever for selectively engaging said brake pad into pressure contact with said winch pulley, and at least one brake link member pivotably attached to and for mechanical communication between said pivot bracket and said at least one brake lever.

2. The apparatus of claim 1, wherein said tow assembly further comprises:

a tow hitch releasably connected to a tow ball mount of said tow vehicle;

an elongated tow bar extending from a central leading edge of said frame affixed to said tow hitch; and, an adjustable trailer jack perpendicularly disposed along said tow bar for adjustably positioning and supporting a distal end of said trailer assembly.

3. The apparatus of claim 1, wherein said splitter wedge further comprises a tong hook protruding from a planar rear surface for retaining said log tong when not in use.

4. The apparatus of claim 1, wherein said trailer assembly further comprises a location for mounting a battery and a platform for securely holding a fuel container.

5. The apparatus of claim 4, wherein said apparatus further comprises a front light and a rear light mounted to an upper end of said support structure;

wherein said front and rear lights are in electrical communication with said battery.

6. The apparatus of claim 1, wherein said boom assembly further comprises a tubular cable guide extending upwardly from said support structure above said winch spool;

wherein said boom further comprises an elongated boom arm and a generally "L"-shaped base pivotably mounted atop said cable guide having a vertical roller for contact with said cable guide; and, wherein said lifting cable is routed through said cable guide over a rear pulley assembly to a front pulley assembly.

7. The apparatus of claim 6, wherein said boom assembly further comprises a slope plate having a horizontal lower face and a sloped upper face, said slope plate is pivotably mounted between said cable guide and said boom base; and, wherein said boom base further comprises a horizontal roller for contact with said slope plate upper face for biasing said boom toward a central and lowermost position of said slope plate upper face.

8. The apparatus of claim 6, wherein said boom arm is pivotably attached to said boom base and an angle of inclination is selectable by adjusting a length of a chain affixed to rear chain loop disposed upon said boom base and looped through a front chain loop disposed on an end of said boom arm; and, wherein said length of said chain is adjusted by pulling an end of said chain through said front chain loop and securing it to an intermediate location upon said chain by a chain lock link.

9. The apparatus of claim 1, wherein said winch drive control mechanism further comprises a pair of engaging levers disposed on opposing sides of said trailer assembly;

wherein said pair of engaging levers is pivotably connected by an offset engaging lever link, such that each of said pair of engaging levers is oriented in a similar position relative to a user.

10. The apparatus of claim 9, wherein said winch drive control mechanism further comprises:

a plurality of engaging link members pivotably connected to adjacent engaging link members for providing mechanical communication between said engaging lever link and said roller arm; and, a spring connected between one of said plurality of engaging link members and said supporting structure for providing an automatic return of said engaging roller to an unengaged position.

11. The apparatus of claim 1, wherein said braking mechanism further comprises a pair of brake levers disposed on opposing sides of said trailer assembly;

wherein said pair of braking levers is pivotably connected by an offset brake lever link, such that each of said pair of brake levers is oriented in a similar position relative to a user.

12. The apparatus of claim 11, wherein said brake mechanism further comprises a plurality of brake link members pivotably connected to adjacent brake link members for providing mechanical communication between said brake lever link and said pivot bracket; and, wherein said pivot bracket is locked when rotated past a center position such that said brake pad is in pressure contact with a braking groove on said winch pulley.

13. The apparatus of claim 1, wherein said hydraulic assembly further comprises:

a pressure gauge in fluid communication between said hydraulic pump and said hydraulic control valve for providing visual indication of fluid pressure going into an inlet port of said hydraulic control valve; and, a filter in fluid communication between said hydraulic control valve and an outlet port of said hydraulic fluid storage tank for filtering hydraulic fluid prior to return to said hydraulic fluid storage tank.

14. A trailer-mounted table wood splitting apparatus comprising:

a trailer assembly comprising a frame for structural support, a floor affixed to said frame for supporting operational assemblies, a tow assembly affixed to a distal end of said frame for removable connection to a tow vehicle, a location for mounting a battery, a platform for securely holding a fuel container, and a pair of wheel assemblies attached to opposing sides of said frame;

a splitter wedge rigidly affixed on said floor disposed toward a front end having a pair of sloped surfaces facing a rear end of said trailer assembly for splitting wood forced against said splitter wedge and a tong hook protruding from a planar rear surface for retaining said log tong when not in use;

a hydraulic assembly comprising a hydraulic cylinder mounted to said floor and aligned with said splitter wedge for forcing wood against said splitter wedge, a hydraulic pump for driving said hydraulic cylinder, a hydraulic control valve in fluid communication between said hydraulic pump and said hydraulic cylinder for controlling actuation of said hydraulic cylinder, and a hydraulic fluid storage tank in fluid communication with said hydraulic pump;

a boom assembly comprising a supporting structure affixed to said trailer assembly rear end, a tubular cable guide extending upwardly from said support structure, a generally "L"-shaped boom base pivotably mounted atop said cable guide having a vertical roller for contact with said cable guide, an elongated boom arm pivotably mounted to said boom base and extending laterally therefrom, a front pulley assembly disposed on a distal end of said boom arm, a rear pulley assembly disposed atop said boom base, and a lifting cable routed through said cable guide over said rear pulley assembly to said front pulley assembly and terminating at a log tong for lifting and placement of wood;

a winch assembly comprising a winch spool affixed to an end of said lifting cable opposite said log tong for winding up and winding out said lifting cable, a winch shaft affixed through said winch spool and rotatably mounted to said supporting structure, and a winch pulley rigidly affixed to an end of said winch shaft for cranking said winch spool;

a drive assembly comprising an engine having a rotating drive shaft and an engine pulley affixed to said drive shaft, a transmission for providing speed and torque conversion of said drive shaft having an input pulley in mechanical communication with said engine pulley by an engine pulley belt and an output pulley in mechanical communication with a drive pulley by a transmission belt, and a friction pulley rigidly connected to said drive pulley and in mechanical communication with said winch pulley by a winch belt;

a winch drive control mechanism comprising an engaging roller selectively engaged into pressure contact with a slack side of said winch belt from an outside position, an elongated off-set roller arm affixed to said engaging roller and rotatably connected to said supporting structure, a pair of engaging levers disposed on opposing sides of said trailer assembly for selectively engaging said engaging roller into pressure contact with said slack side of said winch belt pivotably connected by an offset engaging lever link, such that each of said pair of engaging levers is oriented in a similar position relative to a user, a plurality of engaging link members pivotably connected to adjacent engaging link members for providing mechanical communication between said engaging lever link and said roller arm, and a spring connected between one of said plurality of engaging link members and said supporting structure for providing an automatic return of said engaging roller to an unengaged position; and, a braking mechanism comprising a brake pad selectively engaged into pressure contact with said winch pulley, a bracket connected to said brake pad, a pair of brake levers disposed on opposing sides of said trailer assembly for selectively engaging said brake pad into pressure contact with said winch pulley pivotably connected by an offset brake lever link, such that each of said pair of brake levers is oriented in a similar position relative to said user, and a plurality of brake link members pivotably connected to adjacent brake link members for providing mechanical communication between said brake lever link and said pivot bracket, said pivot bracket is locked when rotated past a center position such that said brake pad is in pressure contact with a braking groove on said winch pulley.

15. The apparatus of claim 14, wherein said tow assembly further comprises:

a tow hitch releasably connected to a tow ball mount of said tow vehicle;

an elongated tow bar extending from a central leading edge of said frame affixed to said tow hitch; and, an adjustable trailer jack perpendicularly disposed along said tow bar for adjustably positioning and supporting a distal end of said trailer assembly.

16. The apparatus of claim 15, wherein said boom assembly further comprises a slope plate having a horizontal lower face and a sloped upper face, said slope plate is pivotably mounted between said cable guide and said boom base; and, wherein said boom base further comprises a horizontal roller for contact with said slope plate upper face for biasing said boom toward a central and lowermost position of said slope plate upper face.

17. The apparatus of claim 16, wherein said boom arm is pivotably attached to said boom base and an angle of inclination is selectable by adjusting a length of a chain affixed to rear chain loop disposed upon said boom base and looped through a front chain loop disposed on an end of said boom arm; and, wherein said length of said chain is adjusted by pulling an end of said chain through said front chain loop and securing it to an intermediate location upon said chain by a chain lock link.

18. The apparatus of claim 17, wherein said hydraulic assembly further comprises:

a pressure gauge in fluid communication between said hydraulic pump and said hydraulic control valve for providing visual indication of fluid pressure going into an inlet port of said hydraulic control valve; and, a filter in fluid communication between said hydraulic control valve and an outlet port of said hydraulic fluid storage tank for filtering hydraulic fluid prior to return to said hydraulic fluid storage tank.

19. The apparatus of claim 18, wherein said apparatus further comprises a front light and a rear light mounted to an upper end of said support structure;

wherein said front and rear lights are in electrical communication with said battery.

20. The apparatus of claim 19, wherein said trailer assembly further comprises at least one reflector disposed on opposing side edges of said frame; and, a wheel well disposed on said opposing side edges, each wheel well for receiving said wheel assembly.

* * * * *